United States Patent [19]

Brand

[11] Patent Number: 4,474,190

[45] Date of Patent: Oct. 2, 1984

[54] METHOD AND APPARATUS FOR REGULATING THE OPERATION OF MACHINES FOR THE PRODUCTION OF CIGARETTES OR THE LIKE

[75] Inventor: Peter Brand, Hamburg, Fed. Rep. of Germany

[73] Assignee: Hauni-Werke Körber & Co. KG, Hamburg, Fed. Rep. of Germany

[21] Appl. No.: 357,281

[22] Filed: Mar. 11, 1982

[30] Foreign Application Priority Data

Mar. 21, 1981 [DE] Fed. Rep. of Germany ..... 3111242

[51] Int. Cl.[3] ..... A24C 5/18; A24C 5/32

[52] U.S. Cl. ..... 131/84 R; 131/84 C; 131/904; 131/905; 131/906

[58] Field of Search ..... 131/84 C, 906, 84 R, 131/108, 281, 904, 905

[56] References Cited

U.S. PATENT DOCUMENTS

| | | | |
|---|---|---|---|
| 3,288,147 | 11/1966 | Molins et al. | 131/84 C |
| 3,604,429 | 9/1971 | DeWitt | 131/84 R |
| 3,672,373 | 6/1972 | Dögl et al. | 131/84 R |
| 3,750,675 | 8/1973 | Klemme | 131/84 C |
| 3,783,881 | 1/1974 | Lakos | 131/84 C |
| 4,020,851 | 5/1977 | Schloesser et al. | 131/906 |
| 4,063,563 | 12/1977 | Lorenzen | 131/84 C |
| 4,103,535 | 8/1978 | Mutter et al. | 131/904 |
| 4,326,542 | 4/1982 | Laszlo et al. | 131/906 |

*Primary Examiner*—V. Millin
*Assistant Examiner*—Harry J. Macey
*Attorney, Agent, or Firm*—Peter K. Kontler

[57] ABSTRACT

Pileups of tobacco particles at or between the inlet of the draping mechanism and the stream forming station in a cigarette maker are ascertained by a device which monitors the density of successive increments of the cigarette stream prior or subsequent to trimming or the extent of deformation of the finger which compresses the trimmed stream in the garniture of the cigarette maker. The monitoring device generates signals which are utilized to automatically interrupt the admission of tobacco particles into the stream forming channel.

24 Claims, 6 Drawing Figures

METHOD AND APPARATUS FOR REGULATING THE OPERATION OF MACHINES FOR THE PRODUCTION OF CIGARETTES OR THE LIKE

BACKGROUND OF THE INVENTION

The present invention relates to improvements in machines for the production and/or processing of cigarettes and/or other types of rod-shaped articles which constitute or form part of smokers'products. More particularly, the invention relates to improvements in the making of rod-shaped articles which are produced by drawing a relatively thin but wide continuous layer of tobacco particles from a suitable source, converting the layer into a narrow continuous stream which moves lengthwise, draping the stream into a web of cigarette paper or the like to form a wrapped stream or rod, and severing the rod at selected intervals so that the rod yields a succession of rod-shaped sections (e.g., plain cigarettes) of unit length or multiple unit length. The above-enumerated steps can be carried out in a cigarette maker or another machine wherein a distributor contains a supply of tobacco particles and is provided with means for forming the layer, for converting the layer into a narrow stream, for trimming the stream, for draping the trimmed stream (filler), and for converting the resulting rod into discrete rod-shaped articles. As a rule, the stream and the filler are attracted by suction to one or more foraminous belt conveyors so that they remain in the prescribed path and advance at the speed of such conveyor or conveyors.

It is already known to monitor the operation of a cigarette maker or another machine or combination of two or more cooperating machines which produces or processes rod-shaped articles constituting or forming part of smokers' products. Such monitoring is desirable and advantageous because rapid detection of a malfunction can greatly reduce the losses in output; this is particularly important in modern high-speed cigarette makers or like machines which turn out in excess of 100 articles per second. Thus, it is desirable to ensure that the down times of the machine be reduced to a minimum because each and every minute of stoppage entails the loss of more than 6000 articles. As a rule, a cigarette maker, a filter tipping machine, a filter rod maker, a packing machine or an analogous machine which produces or processes rod-shaped articles of the tobacco processing industry is equipped with a host of monitoring devices which are designed to ascertain numerous widely different causes of malfunction. In most instances, the detection of a defect or malfunction entails immediate stoppage of the entire machine, group of machines or production line. One of the numerous malfunctions or defects is the breakage of the cigarette rod in a cigarette maker (such defect or malfunction is also known as a stopper). The primary or frequent cause of such types of defects is a pileup of tobacco particles at the inlet of the mechanism which drapes a continuous web of cigarette paper or other suitable wrapping material around a rod-like filler of tobacco particles, i.e., around a stream which has been trimmed or equalized for the purpose of removing the surplus of tobacco therefrom. The accumulated particles are incapable of advancing beyond the inlet so that the filler breaks downstream of the inlet to thus cause a breakage of the web of wrapping material. This means that the customary cutoff is incapable of subdividing the cigarette rod into rod-shaped articles of desired length, and the absence of articles is detected by a suitable monitoring device to initiate stoppage of the cigarette maker. Such monitoring device is normally installed at or close to the discharge end of the cutoff, i.e., not far from the inlet of the draping mechanism. Nevertheless, the relatively short interval of time which elapses between the instant of breakage of the rod and the detection of absence of rod-shaped articles at the discharge end of the cutoff suffices to entail complete or substantial clogging of the path along which the tobacco stream advances from the stream forming zone to the inlet of the draping mechanism. This holds especially true for the aforediscussed modern cigarette makers which turn out extremely large quantities of rod-shaped articles per unit of time. Accumulations of tobacco particles upstream of the inlet to the draping mechanism entail clogging of a portion of the distributor as well as of the channel wherein the untrimmed stream and the filler advance toward the draping mechanism. Consequently, each breakage of the cigarette rod necessitates an opening of the distributor, removal of accumulated tobacco particles, cleaning of the channel wherein the stream advances toward the draping mechanism, and cleaning of the conveyor means which transport the stream and the filler toward such mechanism. As a rule, the cleaning operation is performed by hand which is a time-consuming operation and can take up an interval of time during which the machine would have turned out tens and tens of thousands of smokers' products. Moreover, the machine must be provided with numerous doors and/or openings which afford access to certain portions of the distributor and to the tobacco channel. Still further, tobacco particles which pile up in the distributor and/or in the tobacco channel are highly likely to be comminuted so that they must be discarded or subjected to costly treatment preparatory to readmission into the distributor of the cigarette maker. Finally, breakage of the web of wrapping material necessitates the initiation of a splicing operation which also involves losses in time and often requires attendance by a skilled operator.

OBJECTS AND SUMMARY OF THE INVENTION

An object of the invention is to provide a novel and improved method of regulating the operation of a cigarette maker, or another machine for the production and/or processing of rod-shaped articles which constitute or form part of smokers' products, in such a way that the pileup of tobacco particles in the event of breakage of the tobacco-containing wrapped filler is held to a minimum and that such pileup need not be eliminated by hand.

Another object of the invention is to provide a novel and improved method of immediately or rapidly ascertaining or detecting breaks in the cigarette rod which is produced in a cigarette maker so that remedial measures for elimination of the causes of a break can be undertaken practically without delay.

A further object of the invention is to provide a method which reduces the losses in tobacco as a result of breaks in the cigarette rod.

An additional object of the invention is to provide a method which contributes to higher output of cigarette makers or analogous machines.

A further object of the invention is to provide a method of the above outlined character which limits the pileups of tobacco particles (if any) to the region immediately preceding the inlet of the draping mechanism for a trimmed tobacco stream.

An additional object of the invention is to provide a novel and improved apparatus for the practice of the above-outlined method and to construct and assemble the apparatus in such a way that it takes up a minimal amount of space in a cigarette maker or another tobacco processing machine.

A further object of the invention is to provide a machine, or a combination of several machines, which embodies the improved apparatus.

An additional object of the invention is to provide an apparatus which is not only simple and inexpensive but also rugged, reliable and capable of installation in existing cigarette makers or analogous machines.

An additional object of the invention is to provide the above-outlined apparatus with novel and improved means for monitoring certain portions of a cigarette maker or a like machine for the purpose of immediately detecting any pileups of tobacco particles which are likely to lead to breakage of the cigarette rod or its constituent(s).

A further object of the invention is to provide novel and improved means for interrupting the building of a tobacco stream in a cigarette maker or an analogous machine when the cigarette rod is about to break or when the breakage of the rod occurs as a result of a pileup of tobacco particles upstream of the filler draping mechanism.

Another object of the invention is to provide a cigarette maker which embodies the above-outlined apparatus and is capable of reducing losses in tobacco, time and/or output to a fraction of losses which are incurred in conventional cigarette makers as a result of breakage of the cigarette rod.

One feature of the invention resides in the provision of a method of producing rod-shaped articles which constitute or form part of smokers' products, particularly in a method of producing plain cigarettes, cigars or cigarillos. The method comprises the steps of establishing and maintaining a supply of tobacco particles (e.g., in the reservoir or magazine of the distributor in a cigarette maker), withdrawing from the supply a continuous (preferably wide) layer of tobacco particles and converting the layer into a continuous stream whose width is preferably a small fraction of the width of the layer (such withdrawal and conversion normally involve showering or otherwise admitting the leader of the layer into a relatively narrow tobacco channel whose bottom wall is constituted by one or more endless foraminous belt conveyor means which move the growing stream lengthwise along the aforementioned path), advancing the stream lengthwise along the path (such advancing step is preferably carried out by the aforementioned foraminous conveyor means), draping the stream into a web of cigarette paper or other suitable wrapping material in a first portion of the path, subdividing the draped stream into rod-shaped sections of predetermined length (e.g., into plain cigarettes of unit length or double unit length), monitoring the mass or quantity of tobacco particles in successive increments of the stream in a second portion of the path upstream of the first portion and generating signals denoting the monitored quantities of tobacco particles, and automatically interrupting (i.e., temporarily terminating) the converting and/or withdrawing step when a thus generated signal denotes that the quantity of tobacco particles in the respective increment exceeds a preselected value. The interrupting step preferably includes utilizing the respective signal to automatically initiate an interruption of the converting and/or withdrawing step (the converting step is terminated or interrupted in automatic response to termination or interruption of the withdrawing step).

In accordance with one of the presently preferred embodiments of the method, the monitoring step can comprise conveying through the stream a current of a gaseous fluid in a direction transversely of the second portion of the path and ascertaining the difference between the characteristics of the current prior to penetration into and subsequent to emergence or issuance from the stream in the second portion of the path. The conveying step can comprise establishing a subatmospheric pressure at one side of the stream in the second portion of the path to thereby induce the flow of atmospheric air across the stream whereby the pressure of air at the one side of the path fluctuates as a function of the mass of tobacco particles advancing along the second portion of the path.

Alternatively, the monitoring step can include ascertaining the height of successive increments of the tobacco stream in the second portion of the path; such height is or can be proportional to the mass of tobacco particles in the respective increments of the stream. The just mentioned ascertaining step can include optically scanning the height of the tobacco stream, preferably without contacting the stream, and the signal generating step can include employing a photoelectronic transducer arrangement which converts optical signals into electrical signals that are indicative of the mass or quantity of tobacco particles in successive monitored increments or unit lengths of the stream.

Still further, the monitoring step can include capacitively measuring the mass of tobacco particles in successive increments or unit lengths of the tobacco stream.

In accordance with another embodiment of the method, the monitoring step can include establishing a constriction through which successive increments of the stream advance in the second portion of the path and ascertaining the forces which successive increments of the stream apply to such constriction; the magnitude of the just mentioned forces is indicative of the mass of tobacco particles in the respective increments of the stream. Otherwise stated, the just discussed embodiment of the method involves or can involve reducing the cross-sectional area of the second portion of the path so that successive increments of the stream are compressed during travel along the second portion of the path and the resistance which successive increments of the stream offer to compression is indicative of the mass of tobacco particles in the respective increments. The interrupting step then includes automatically terminating the converting and/or withdrawing step when the resistance of an increment to compression during travel along the second portion of the path exceeds a preselected threshold value.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
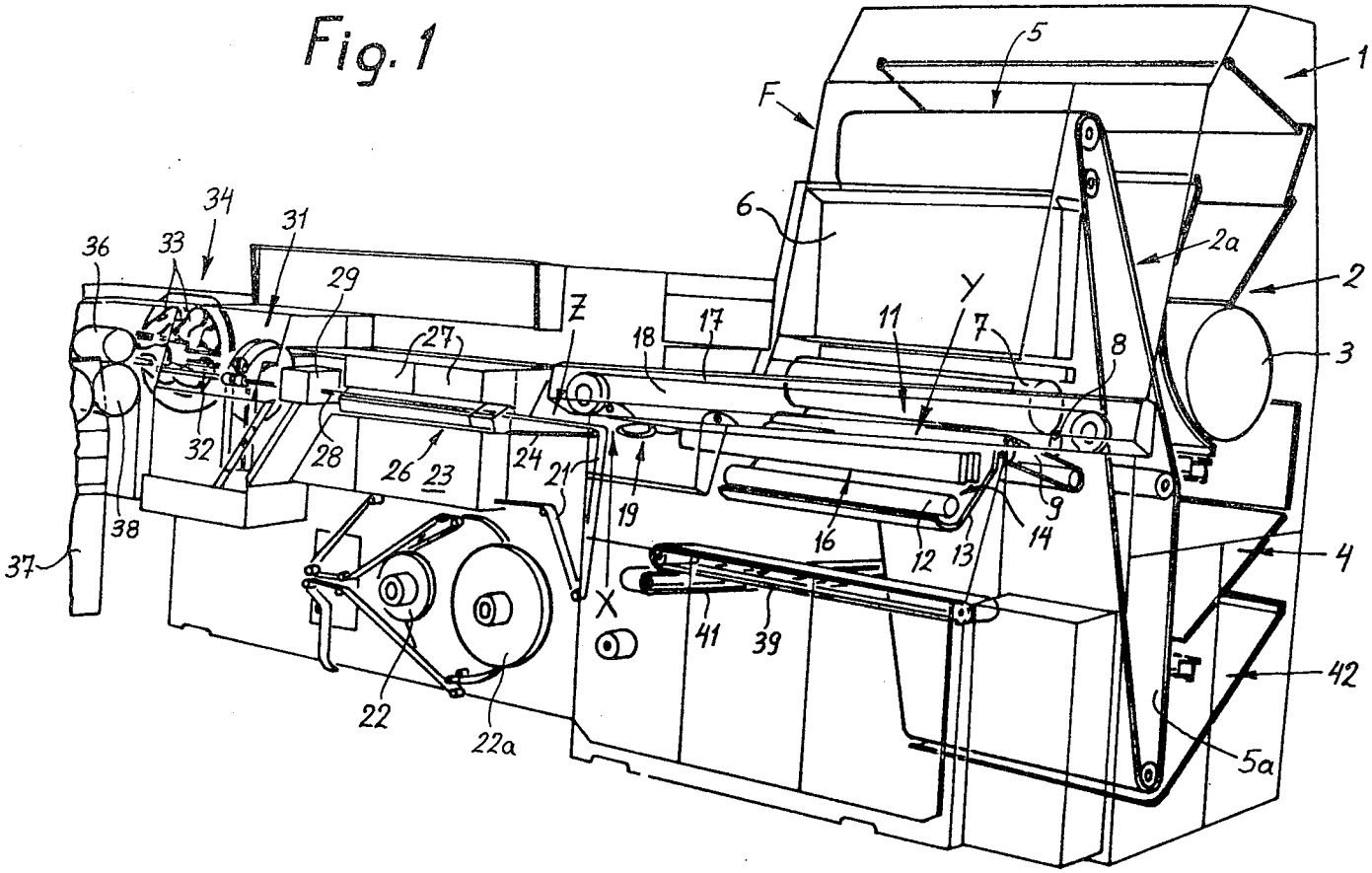
FIG. 1 is a somewhat schematic perspective view of a cigarette maker which can be provided with an apparatus embodying the present invention, and further showing a portion of a filter tipping machine which receives plain cigarettes from the cigarette maker.

Referring first to FIG. 1, there is shown a cigarette rod making machine of the type known as PROTOS which is manufactured and sold by the assignee of the present application. This machine is designed to normally turn out plain cigarettes at a rate which is in excess of 6000 per minute and is directly coupled with a filter tipping machine 37, e.g., a machine known as MAX, MAX S or MAX 80 (all manufactured and sold by the assignee of the present application). A MAX S machine is disclosed, for example, in commonly owned U.S. Pat. No. 4,280,187 granted July 21, 1981 to Reuland et al. The disclosure of this patent is incorporated herein by reference.

The machine of FIG. 1 comprises a frame or housing F which supports a composite distributor including a first or preliminary distributor 2 and a second or final distributor 2*a*. The first distributor 2 receives batches of tobacco particles by way of a gate 1; a rotary drum-shaped conveyor 3 of the distributor 2 serves to admit particles of tobacco into the magazine or reservoir 4 of the second distributor 2*a* at such a rate that the quantity of tobacco particles in the reservoir 4 is at least substantially constant. The second distributor 2*a* further comprises an endless band conveyor 5 whose upwardly advancing reach 5*a* draws tobacco particles from the reservoir 4 and admits the withdrawn tobacco particles into an upright duct 6, again at such a rate that the supply of tobacco particles in the duct 6 does not fluctuate beyond a certain range. Reference may be had to commonly owned U.S. Pat. No. 4,185,644 granted Jan. 29, 1980 to Heitmann et al. which discloses the controls serving to ensure that the supply of tobacco particles in the duct will not drop below or rise above a preselected minimum or maximum level. Similar controls are disclosed in commonly owned U.S. Pat. No. 4,220,164 granted Sept. 2, 1980 to Lorenzen.

The means for withdrawing from the lower end portion of the duct 6 a continuous relatively wide layer or carpet of tobacco particles includes a carded rotary drum-shaped conveyor 7 which cooperates with a rapidly rotating picker roller 8 to form the layer on an endless apron conveyor 9 which is driven at a constant speed. The carding of the conveyor 7 withdraws tobacco particles from the duct 6, and the pins of the picker roller 8 expel the particles from the carding of the conveyor 7 whereby the expelled particles descend onto the adjacent portion of the apron conveyor 9. The apron conveyor 9 cooperates with a suitable sifting device 11 whose function is to effect segregation of heavier particles (such as ribs, birds' eyes, fragments of metal or the like) from satisfactory particles (normally in the form of shreds) before the satisfactory particles reach the tobacco stream forming zone. The exact construction of the sifting device 11 forms no part of the present invention; for example, such device can include means for forming a curtain of air which the heavier particles can traverse owing to their inertia so as to accumulate in a suitable intercepting receptacle (not shown) whereas the lighter (satisfactory) particles are prevented from penetrating the curtain and are compelled to advance toward the tobacco stream forming station. The curtain of air causes such lighter (satisfactory) particles to enter a funnel 14 which is defined by a carded drum-shaped rotary conveyor 12 and a stationary or adjustable wall member 13. The funnel 14 discharges successive increments (i.e., the leader) of the aforementioned layer or carpet into an elongated and relatively narrow tobacco channel 16 which defines an elongated path for a continuous tobacco stream 43 (see FIG. 3). The stream grows in the channel 16 and is caused to advance lengthwise, namely, in a direction to the left, as viewed in FIG. 1.

The bottom wall of the tobacco channel 16 is formed by one elongated reach of an endless foraminous belt conveyor 17 which, as clearly shown in FIG. 3, advances below the perforated bottom wall 18*a* of a stationary suction chamber 18 serving to attract the growing and fully grown stream 43 during travel along the underside of the aforementioned reach of the conveyor 17. The carding of the conveyor 12 propels the particles of tobacco against the exposed side of the conveyor 17 in the channel 16, and such particles are attracted to the conveyor 17 under the influence of the suction chamber 18 so that the particles form a growing wedge-like stream which, when fully grown, advances past a conventional trimming or equalizing device 19 serving to remove the surplus or excess of tobacco particles so that the fully grown stream 43 is converted into a trimmed or equalized rod-like filler 43*a* shown in the upper right-hand portion of FIG. 2.

The filler 43*a* is thereupon wrapped into a web 21 of cigarette paper or other suitable wrapping material in a portion of its path which is located downstream of the trimming device 19. The web 21 is drawn off an expiring reel 22 which is mounted on the frame F adjacent to a fresh reel 22*a*. When the expiring reel 22 is nearly exhausted, it is automatically, semiautomatically or manually spliced to the leader of the fresh reel 22*a* which is then fed into the wrapping or draping mechanism 26 of the cigarette maker. On its way from the reel 22 or 22*a* to the mechanism 26, the web 21 advances through an imprinting mechanism 23 which provides spaced-apart portions of the wrapping material with indicia denoting the name of the manufacturer, the trademark or trademarks of the manufacturer, the brand name and/or other indicia in a manner not forming part of the invention. The wrapping mechanism 26 comprises an endless band or belt conveyor 24 known as garniture and serving to advance the filler 43*a* and the web 21 past and through other portions of the mechanism 26. The exact details of all parts of the mechanism 26 form no part of the invention; as a rule, such mechanism is designed to drape the web 21 around the filler 43*a* so that one marginal portion of the partially draped web extends away from the rod-like filler 43*a* and one side thereof can be coated with a suitable adhesive (e.g., a wet adhesive or a hotmelt) by a conventional paster before the adhesive-coated marginal portion is folded over the other marginal portion to form therewith a seam extending in parallelism with the axis of the resulting continuous cigarette rod 28. The seam is heated or cooled (depending on the nature of adhesive) by a two-part plate-like sealer 27 (reference may be had to the commonly owned U.S. Pat. No. 4,291,713 granted Sept. 29, 1981 to Frank) to ensure that the seam can stand stresses which arise when the rod 28 is severed at regular intervals during travel through a cutoff 31 so as to yield a single file of discrete plain cigarettes 32 of double unit length. A density monitoring device 29 is installed in or on the frame F upstream of the cutoff 31 to ascertain the density of successive increments of the draped filler 43*a* and to regulate the trimming device 19 accordingly. The monitoring device 29 can include a source of corpuscular radiation and an ionization chamber or another transducer serving to generate signals denoting the density of successive increments of the filler 43*a*. The signals are used to change the position of the trimming device 19 relative to the conveyor 17 in the channel 16, i.e., to regulate the quantity of tobacco which is removed from the fully grown stream. Such monitoring devices are standard components of cigarette makers. See, for example, the commonly owned copending applicaton Ser. No. 302,240 filed Sept. 14, 1981 by Reuland.

Successive cigarettes 32 of the aforementioned file are engaged by successive arms 33 of a rotary transfer unit 34 which delivers the cigarettes 32 into successive flutes of a rotary drum-shaped row forming conveyor 36 forming part of the filter tipping machine 37. A severing drum 38 of the machine 37 cooperates with the conveyor 36 to divide each cigarette 32 into two coaxial plain cigarettes of unit length. The (non-illustrated) remaining parts of the filter tipping machine 37 thereupon assemble each pair of coaxial plain cigarettes with a filter rod section of double unit length to form filter cigarettes of double unit length. Such cigarettes are thereupon halved to yield pairs of filter cigarettes of unit length, one cigarette of each pair is turned end-for-end and placed between the non-inverted cigarettes to form a single row wherein the filter cigarettes of unit length advance through a testing unit and thereupon to storage or directly to a packing machine.

The cigarette maker of FIG. 1 further comprises endless belt conveyors 39 and 41 which deliver the removed surplus of tobacco particles from the trimming device 19 back into the second distributor 2*a*, namely, into a magazine 42 which is disposed below the magazine or reservoir 4 and is adjacent to the upwardly moving reach 5*a* of the conveyor 5 so that the latter removes some of the returned tobacco prior to removal of tobacco particles from the main reservoir 4. Reference may be had to the aforementioned commonly owned U.S. Pat. No. 4,185,644 to Heitmann et al.

Figure 2:
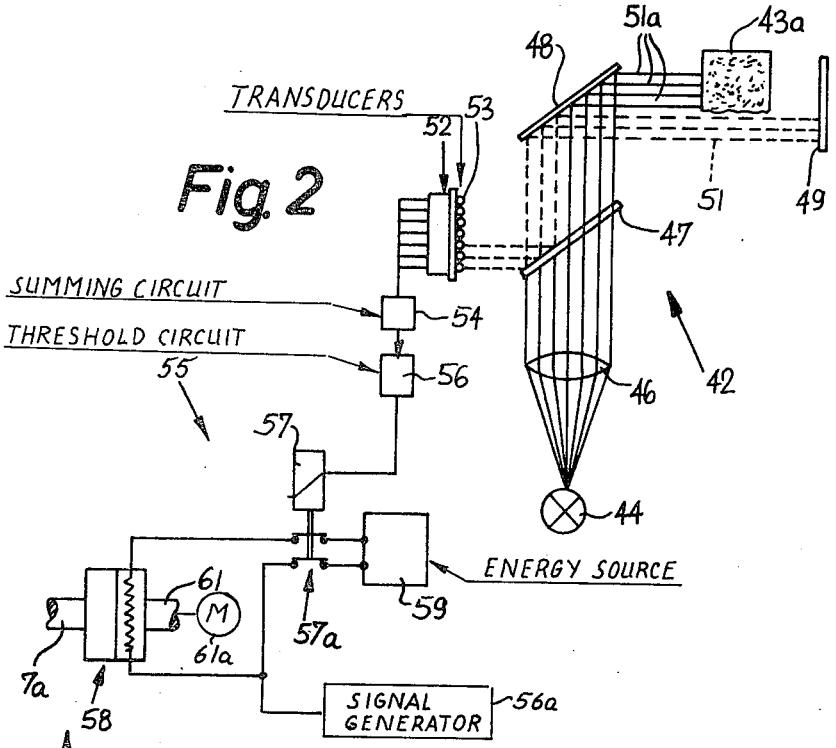
FIG. 2 is a diagrammatic view of an apparatus which embodies one form of the invention and utilizes an optoelectronic device for monitoring the mass of tobacco particles in successive increments of the tobacco stream.

FIG. 2 illustrates the details of an optoelectronic monitoring device 42 which is constructed and assembled in accordance with a first embodiment of the invention and serves to effect an automatic interruption of the delivery of tobacco particles into the channel 16 when the path which is defined by the conveyors 17 and 24 is clogged or is about to be clogged. The monitoring device 42 is designed to monitor the mass or density of successive increments of the equalized tobacco stream (i.e., of the filler 43*a*) downstream of the trimming device 19 but upstream of that portion of the path wherein the filler 43*a* is draped into the cigarette paper web 21. A presently preferred position of the monitoring device 42 in the cigarette maker of FIG. 1 is indicated by the arrow X.

The device 42 comprises a light source 44 which directs light rays against a lens 46 serving to direct parallel rays against one side of a partially light-transmitting mirror 47. The light rays which pass through the mirror 47 are reflected by a second mirror 48 which is disposed at one side of the path of the filler 43*a*, namely, at one side of that (second) portion of the path which is pinpointed by the arrow X of FIG. 1. The mirror 48 reflects the light rays so that they travel transversely of and across the path of the filler 43*a* to be reflected by a fully reflecting third mirror 49. The filler 43*a* intercepts a certain percentage of light rays so that the light rays 51 which are permitted to reach and to be reflected by the mirror 49 are indicative of the height of the filler 43*a* and hence of the quantity or mass of tobacco particles in successive increments or unit lengths of the trimmed tobacco stream. The reflected light rays 51 are reflected by the mirrors 48 and 47 in such order prior to impinging upon a signal generating component 52 of the device 42. The signal generating component 52 has a battery of phototransistors 53. Each of those phototransistors 53 which are exposed to reflected light rays 51 transmits a signal to a summing circuit 54 whose output signal is indicative of the mass of tobacco particles in the respective increment of the filler 43*a*. In the illustrated embodiment, the component 52 comprises a row of seven phototransistors 53 three of which are caused to generate signals because the corresponding light rays 51 are reflected by the mirror 49 and can reach the component 52. The light rays 51*a* are intercepted by the filler 43*a*.

The output of the summing circuit 54 is connected with the input of a signal generating threshold circuit 56 whose output is caused to energize a relay 57 when the signal appearing at the output of the circuit 54 is indicative of an excessive quantity of tobacco particles in the corresponding increment of the filler 43*a*. The relay 57 forms part of a deactivating or control unit 55 which serves to interrupt the operation of the distributor in the cigarette maker, i.e., to interrupt the building of a tobacco stream 43 in the channel 16, when the output of the threshold circuit 56 transmits a signal, i.e., when the signal at the output of the summing circuit 54 indicates that the quantity of tobacco particles in the corresponding increment of the filler 43*a* is excessive because the quantity of light which is reflected by the mirror 49 is reduced to a preselected minimum value indicating that the quantity of tobacco particles in the filler is likely to entail or has caused a clogging of the channel 16 and/or draping mechanism 26. By way of example, and assuming that the quantity of tobacco particles in the filler 43*a* is acceptable when the height of the filler corresponds to that shown in FIG. 2 (the filler 43*a* is advanced in a direction at right angles to the plane of FIG. 2), the threshold circuit 56 will generate a signal to energize or deenergize the relay 57 when the number of activated phototransistors 53 in the component 52 is reduced to two. When the operation of the cigarette maker is normal, the contacts 57*a* of the relay 57 are closed so that the relay connects an electromagnetic clutch 58 in circuit with a suitable source 59 of electrical energy. The clutch 58 is then engaged and transmits torque from the main drive shaft 61 of the cigarette maker to the shaft 7*a* of the conveyor 7 which draws tobacco particles from the lower end of the duct 6, i.e., which causes the formation of the relatively thin but wide layer on the apron conveyor 9 and hence the conversion of such layer into the relatively narrow tobacco stream 43 in the channel 16. The shaft 61 is driven by a main prime mover (e.g., an electric motor 61*a*) which drives all or nearly all mobile parts of the cigarette maker and/or filter tipping machine 37.

If the orderly transport of tobacco particles along the path defined by the conveyors 17 and 24 is interrupted or impeded for any one of a variety of reasons, this normally entails an accumulation or pileup of tobacco particles at the inlet of the draping mechanism 26, i.e., downstream of the location (arrow X in FIG. 1) of the monitoring device 42. A pileup will develop as a result of delivery of excessive quantities of tobacco particles because the wrapping or draping mechanism 26 includes or is immediately preceded by a compacting device including a stream-contacting member in the form of a finger, e.g., a member of the type shown at 387 in FIG. 5 of the drawing. The member 387 is stationary and provides a constriction in the path of movement of the filler 43*a*. If the quantity of tobacco in an oncoming increment of the filler 43*a* is excessive, the member 387 causes the particles of tobacco to pile up at the inlet of the mechanism 26 whereby the filler 43*a* is interrupted with attendant interruption of the making of a continuous cigarette rod 28. The pileup which normally develops at the inlet of the mechanism 26 propagates itself backwardly, i.e., toward the location where the stream 43 is formed as a result of admission of tobacco particles into the channel 16 (i.e., as a result of conversion of the aforementioned relatively wide layer or carpet into a relatively narrow tobacco stream). It will be recalled that the conveyor 17 cooperates with the suction chamber 18, i.e., that the stream 43 and the filler 43*a* are attracted to that reach of the foraminous conveyor 17 which forms the bottom wall of the channel 16. This ensures proper transport of tobacco particles toward and onto the conveyor 24 but enhances the accumulation of tobacco particles upstream of the mechanism 26 when the aforementioned member 387 obstructs the advancement of a portion of the filler 43*a* onto the conveyor 24. This means that, once a pileup of tobacco particles develops, such pileup increases very rapidly and entails a breakage of the rod 28 with attendant breakage of the web 21 which, in turn, entails a lengthy and costly interruption of operation of the cigarette maker.

The monitoring device 42 ensures that a pileup at the location X is detected practically instantaneously and that the conversion of the tobacco layer into the stream 43 is interrupted without any or with negligible delay. This is due to the fact that the device 42 is closely adjacent to the aforementioned member 387 and its component 52 detects a pileup practically instantaneously because such pileup prevents the light rays from reaching the mirror 49, i.e., from being reflected against the phototransistors 53. The intensity of the signal at the output of the summing circuit 54 then decreases, normally to zero, and the signal at the output of the threshold circuit 56 causes the relay 57 to open its contacts 57*a*, i.e., the clutch 58 is disengaged and the main drive shaft 61 ceases to drive the shaft 7*a* of the withdrawing conveyor 7 in the second distributor 2*a*.

If the drive for the conveyor 17 is not interrupted simultaneously with disengagement of the clutch 58, the conveyor 17 merely transports that (relatively small) quantity of tobacco particles which has been transferred into the channel 16 prior to stoppage of the shaft 7*a*. When the cause of malfunction of the draping mechanism 26 (and/or of malfunction of any other component or components which has or have caused the pileup at the inlet of the mechanism 26) is eliminated, the cigarette maker can resume the making of cigarettes 32 without necessitating a cleaning of the channel 16 and/or conveyor 17. In other words, all that is necessary is to eliminate the cause of the pileup at the inlet of the mechanism 26 but there is no need for any other operations (such as cleaning of the channel 16 and/or conveyor 17) which would necessitate additonal time and would thus entail a more pronounced reduction of the output. It goes without saying that the signal at the ouput of the threshold circuit 56 can be transmitted to a suitable device (shown at 56*a* in FIG. 2) which generates a visible, audible and/or otherwise detectable signal in order to apprise the attendants of the pileup at the inlet of the mechanism 26.

The novel method and apparatus take advantage of the fact that an immediate or direct consequence of a stopper (breakage of the cigarette rod 28) is an increase in the quantity of tobacco particles on the conveyor 17 and/or 24, i.e., in the untrimmed stream 43 and/or in the trimmed stream or filler 43*a*. The monitoring device 42 detects such increase in the mass or quantity of tobacco particles in the region between the locus of application of the web 21 around the filler 43*a* and the locus of formation of the stream 43 and generates signals which are utilized for automatic interruption of admission of tobacco particles into the channel 16. This ensures that the pileup cannot propagate itself into the distributor proper. Therefore, the machine can be restarted as soon as the cause of the pileup is eliminated, i.e., without necessitating any cleaning of the channel 16 and/or conveyor 17 and/or manual removal of tobacco particles from the distributor 2*a*. This reduces losses in tobacco, particularly those losses which are attributable to comminution of tobacco shreds.

It is already known to monitor the quantity of tobacco in the unwrapped tobacco stream. However, such monitoring takes place for the purpose of adjusting the position of the trimming device relative to the conveyor for the tobacco stream, i.e., for the purpose of increasing or reducing the rate of tobacco removal from the stream (refer to the aforementioned copending application Ser. No. 302,240 of Reuland). In other words, heretofore known proposals to monitor the quantity of tobacco in the stream are known in connection with attempts to remove tobacco from the stream at such a rate that the remaining portion of the stream constitutes a filler wherein the quantity or weight per unit length is constant or within a desired range.

The monitoring device 42 of FIG. 2 exhibits the advantage that its elements need not contact the particles of tobacco which form the filler 43*a*, i.e., that such elements cannot contribute to comminution of tobacco shreds. As mentioned above, this device automatically generates a signal when the height of the trimmed stream 43*a* exceeds a predetermined value indicating that the trimmed stream contains an excessive quantity of tobacco particles, namely, a quantity which is attributable to a pileup at the inlet of the draping mechanism 26 and/or elsewhere along the path of the untrimmed stream 43 or trimmed stream or filler 43*a*. As mentioned above, the monitoring device 42 is preferably placed adjacent to the path of the trimmed stream or filler 43*a*; however, it can also be located adjacent to the path of the untrimmed stream 43, especially if the nature of tobacco particles is such that the freshly grown stream 43 does not exhibit strongly pronounced hills and valleys, i.e., when the quantity of tobacco particles in the stream 43 does not fluctuate within a very wide range such that the upper limit of the range could mistakenly represent (to the monitoring device 42) a pileup at the inlet of the mechanism 26 with attendant unnecessary interruption of admission of tobacco particles into the channel 16.

Figure 3:
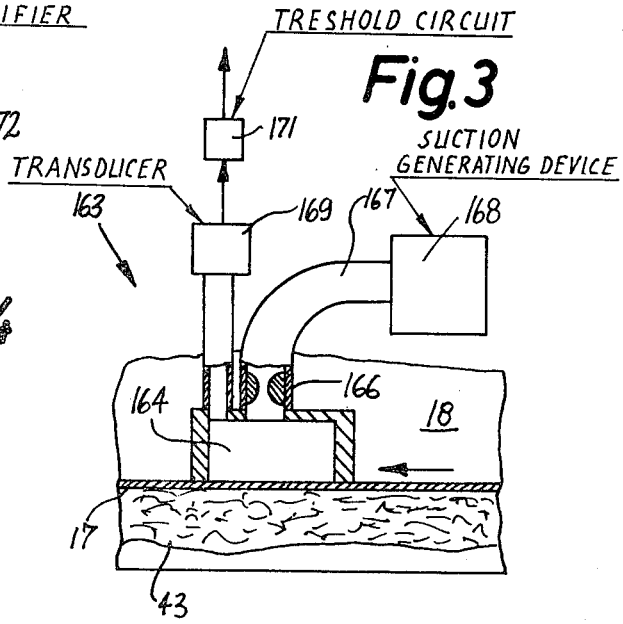
FIG. 3 is an enlarged fragmentary longitudinal sectional view of the cigarette maker and a diagrammatic view of a pneumatic device which forms part of a modified apparatus and serves to monitor the mass of tobacco particles in successive increments of the tobacco stream in a machine of the type shown in FIG. 1.

FIG. 3 illustrates a pneumatic monitoring device 163 which can be utilized in lieu of the monitoring device 42. The device 163 includes means for establishing the flow of a current of a gaseous fluid (preferably air) across the non-equalized tobacco stream 43 (e.g., in the region indicated by the arrow Y shown in FIG. 1) and for ascertaining the characteristics of such current prior to penetration into and subsequent to emergence or issuance from the stream 43. To this end, a portion 164 of the suction chamber 18 at one side of the path of movement of the unequalized stream 43 draws atmospheric air across the stream (upwardly, as viewed in FIG. 3), and such air flows into a suction generating device 168 (e.g., a suitable fan) by way of a conduit 167 containing a flow restrictor 166. The resistance of the stream 43 to the flow of air thereacross (i.e., the pressure of air in the portion 164 of the suction chamber 18) is indicative of the mass or quanity of tobacco particles in successive increments of the stream 43.

The pressure of air in the portion 164 of the suction chamber 18 is ascertained by a suitable transducer 169 (e.g., a diaphragm type transducer of the type disclosed in commonly owned U.S. Pat. No. 3,412,856 granted Nov. 26, 1968 to Esenwein), whose output transmits signals to a threshold circuit 171 corresponding to the threshold circuit 56 of FIG. 2 and connected with a suitable deactivating or interrupting unit, such as the control unit 55 of FIG. 2. It is clear that the monitoring device 163 can be mounted at any one of a plurality of different locations in the cigarette maker of FIG. 1, e.g., anywhere between the locations pinpointed by the arrows X and Y. In other words, the device 163 can monitor successive increments of the stream 43 or successive increments of the filler 43*a*.

When the resistance which the stream 43 offers to the flow of air into the portion 164 of the suction chamber 18 exceeds a preselected value, the electric signal at the output of the transducer 169 causes the threshold circuit 171 to transmit a signal which disengages the clutch 58 of FIG. 2 or otherwise interrupts the admission of tobacco particles into the channel 16. Such resistance arises or develops, for example, when the particles of tobacco pile up at the inlet of the mechanism 26 or elsewhere along the path of the stream 43 and/or filler 43*a* so that the pileup propagates itself counter to the direction of advancement of tobacco particles with the conveyor 17 and reaches the portion 164 of the suction chamber 18. As a rule, the resistance of the stream 43 to the flow of air into the portion 164 of the suction chamber 18 increases practically immediately upon the development of a pileup so that the interval of improper operation is extremely short and the pileup can be eliminated without necessitating manual evacuation of tobacco particles from the channel 16 and/or a cleaning of the conveyor 17.

The monitoring device 163 of FIG. 3 is very simple and inexpensive. Here, again, a component (suction generating device 168) which is needed in a cigarette maker can perform the additional function of drawing a current of gaseous fluid transversely across the stream 43 (or filler 43*a*, depending on the selected location of the portion 164) in order to enable the transducer 169 to generate signals which denote the resistance offered by the shreds of the tobacco stream 43 or filler 43*a* to the flow of a gaseous medium across the stream. Other means for causing a current of gaseous fluid to flow across the stream 43 or filler 43*a* can be used with equal advantage, as long as the characteristics of the current change sufficiently to be readily detectable in order to allow for the generation of signals which denote the quantity or mass of tobacco particles in successive increments of the stream.

Figure 4:
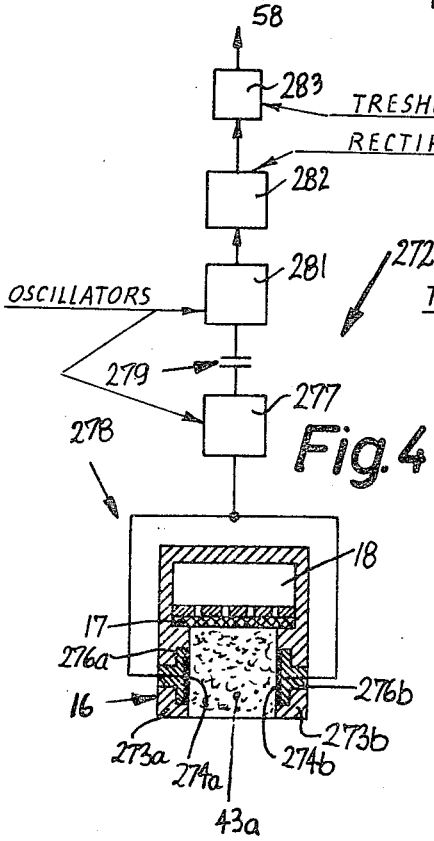
FIG. 4 is an enlarged fragmentary transverse sectional view of the cigarette maker and diagrammatically shows a capacitive device for monitoring the mass of tobacco particles in successive increments of the tobacco stream.

The monitoring device 272 of FIG. 4 is a capacitive monitoring device which can be installed at the location X of FIG. 1, i.e., in a position to monitor the quantity or mass of tobacco particles in successive increments of the filler 43*a*. The channel 16 comprises side walls 273*a* and 273*b* flanking the filler 43*a* and supporting two electrodes 274*a*, 274*b* which are respectively insulated from the channel 16 by electrical insulators 276*a* and 276*b*. See also commonly owned U.S. Pat. No. 4,063,563 granted Dec. 20, 1977 to Lorenzen. These electrodes together constitute the frequency determining capacitor 278 of a high-frequency electrical oscillator circuit 277. The circuit 277 is connected with a high-frequency differential oscillator 281 by a further capacitor 279. The oscillator 281 oscillates at a constant frequency. The frequency of oscillations of the oscillator circuit 277 is a function of the quantity or mass of tobacco particles in successive increments of the filler 43*a* in the channel 16, and such oscillations are superimposed upon the constant-frequency oscillations of the oscillator 281. The resulting output oscillations denote a so-called floating, i.e., the amplitude of the resulting high-frequency potential varies periodically at a given frequency between a minimum and a maximum value. This floating frequency, which corresponds to the difference between the oscillations of the two high-frequency oscillators, is relatively low so that its variations can be readily ascertained. The resulting output voltage of low oscillation frequency is applied to a measuring element in the form of a proportional rectifier 282 which transmits an output signal whose magnitude is at least substantially proportional to the frequency of the input signal. The signal at the output of the rectifier 282 is indicative of the quantity or mass of tobacco particles in the channel 16 and is transmitted to the input of a threshold circuit 283. The output of the circuit 283 transmits a signal when the mass of tobacco particles in an increment of the filler 43*a* reaches a preselected maximum permissible value. The output of the threshold circuit 283 is connected with a deactivating device, e.g., with the relay 57 of the control unit 55 shown in FIG. 2.

The rectifier 282 and the oscillators 277, 281 may be of the type disclosed in commonly owned U.S. Pat. No. 3,996,942 granted Dec. 14, 1976 to Baier. The disclosure of this patent is incorporated herein by reference.

When the material of the filler 43*a* piles up at the inlet of the mechanism 26 shown in FIG. 1, the resulting pileup entails a condensation of the filler 43*a* upstream of the member 387. This, in turn, entails a change in capacitance of the capacitor 278 with the result that the threshold circuit 283 transmits a signal which initiates immediate interruption of admission of tobacco particles into the channel 16, i.e., the conversion of the layer of tobacco particles into the stream 43 is interrupted to thus allow the accumulated tobacco particles to leave the channel 16 and to avoid the need for cleaning of the channel 16 and/or conveyor 17. Since the monitoring device 272 of FIG. 4 is preferably installed at the location X, i.e., close to the inlet of the mechanism 26, the propagation of compression of the filler 43*a* into the range of the electrodes 274*a*, 274*b* is practically instantaneous, especially in a modern high-speed cigarette maker, so that the malfunctioning which has caused the pileup is detected without delay.

Figure 5:
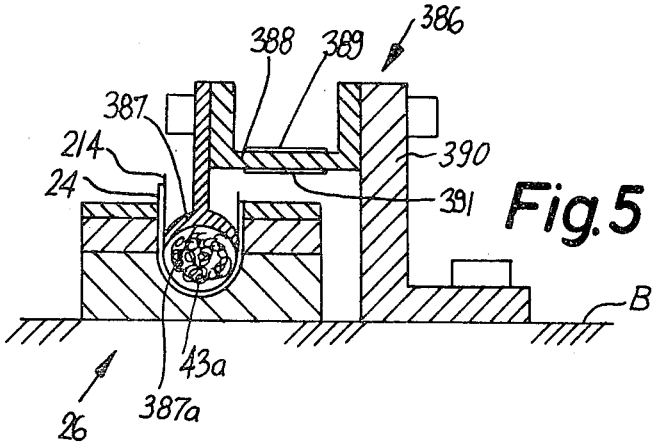
FIG. 5 is a fragmentary transverse vertical sectional view of another portion of the cigarette maker, and further showing certain details of a device which is capable of monitoring the mass of tobacco particles in successive increments of the tobacco stream at the very inlet of the draping mechanism in the maker of FIG. 1.

FIG. 5 shows a further monitoring device 386 which is designed to ascertain the magnitude of the force exerted by the filler 43*a* upon the member or finger 387 at the inlet of the draping mechanism 26 of the machine shown in FIG. 1. The finger 387 is fixedly mounted in the frame F of the cigarette maker; however, it consists at least in part of elastically deformable material (such as steel) so that it can undergo at least some deformation when the pressure of compacted increments of the filler 43*a* against its concave tobacco-contacting surface 387*a* increases. The member 387 can be said to constitute a constriction which reduces the cross-sectional area of the path for the filler 43*a* and thereby entails a compression of successive increments of the filler 43*a*. Such increments offer to compression a resistance which varies as a function of changes in the quantity or mass of tobacco particles in successive increments of the filler. Thus, the force which the filler 43*a* applies to the member 387 is proportional to or indicative of the quantity or mass of tobacco particles in successive increments of the filler. The location of the member 387 in the frame F of the cigarette maker shown in FIG. 1 is indicated by an arrow Z.

The member 387 includes a portion 388 which can be said to constitute a bridge connecting the tobacco-contacting portion (with the surface 387*a*) of the member 387 with a stationary support 390, e.g., a plate which is bolted or otherwise affixed to the bed B; the latter forms part of the frame F. The cross-sectional area and configuration of the bridge 388 are selected in such a way that the surface 387*a* can yield by moving upwardly when the force acting upon such surface increases, i.e., when an increment containing a relatively large mass of tobacco particles is about to advance onto the upper reach of the conveyor 24. The surface 387*a* moves downwardly owing to innate elasticity of the material of the member 387 when the resistance which the filler 43*a* offers to compression decreases. The extent of flexing of the bridge 388 is within the elastic limits of its material.

Figure 6:
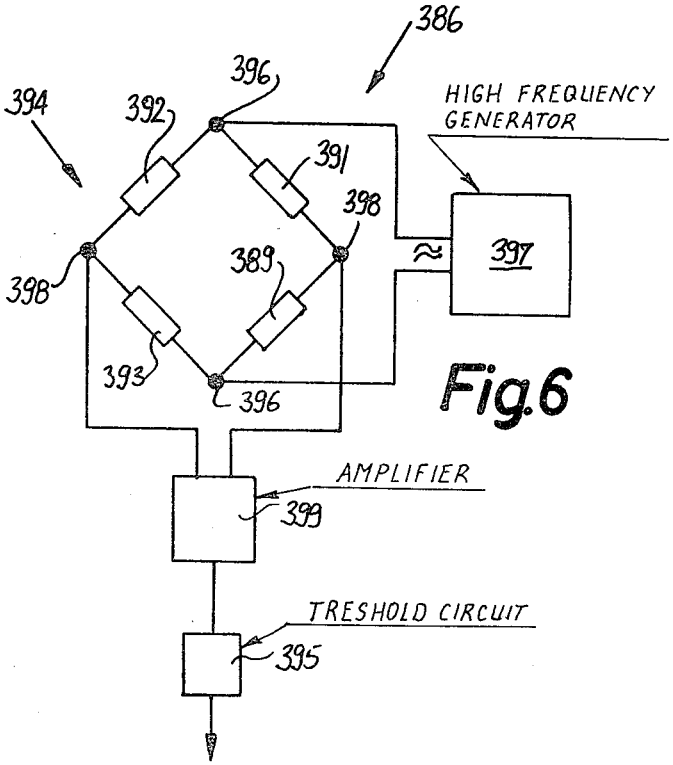
FIG. 6 is a circuit diagram of the remaining parts of the monitoring device which is shown in FIG. 5.

The support 390 further carries four strip-shaped or otherwise configurated conventional expansion measuring elements 389, 391, 392 and 393 (only the strips 389 and 391 can be seen in FIG. 5) which are installed in the bridge circuit 394 of FIG. 6. The strips 389, 391, 392, 393 can be adhesively secured to or otherwise mounted on the bridge 388. FIG. 6 shows that the diagonal 396 of the bridge circuit 394 is connected with a high-frequency generator 397. The other diagonal 398 is connected with an amplifier 399 whose output is connected with the input of a threshold circuit 395. The output of the circuit 395 is connected with a deactivating device, such as the control unit 55 of FIG. 2.

When the member 387 is acted upon by a series of increments of the filler 43*a* whose density or mass is satisfactory, i.e., in the absence of a pileup at the inlet of the draping mechanism 26, the signal at the output of the amplifier 399 does not suffice to initiate the transmission of a signal from the output of the threshold circuit 395 to the relay 57 of FIG. 2 or to an analogous component of the deactivating device for the conveyor 7. However, if the surface 387*a* is acted upon by a relatively large mass of tobacco particles, the bridge 388 is flexed to such an extent that some or all of the strips 389, 391, 392, 393 initiate the transmission of a corresponding signal via diagonal 398 and amplifier 399 so that the threshold circuit 395 initiates the deactivation of means for converting the layer of tobacco particles into a relatively narrow stream. The signal at the output of the circuit 395 entails an energization or deenergization of the relay 57 with the result that the clutch 58 of FIG. 2 is disengaged and the shaft 61 of the cigarette maker ceases to drive the shaft 7*a* for the conveyor 7. It will be noted that the monitoring device 386 of FIGS. 5 and 6 is also capable of interrupting the admission of tobacco particles into the channel 16 without any delay, i.e., in practically immediate response to development of a pileup at the inlet of the draping mechanism 26.

The monitoring device 386 of FIGS. 5 and 6 exhibits the advantage that it necessarily detects the pileup of tobacco particles at the inlet of the draping mechanism 26 without any delay. This will be readily appreciated since the member 387 can be said to constitute a component part of the mechanism 26 or to be located immediately upstream of such mechanism. Moreover, there is no need to provide separate or additional means for reducing the cross-sectional area of the filler 43*a* for the express purpose of ascertaining the force which successive increments of the filler 43*a* apply to the constricting means. In other words, such force is generated by a member (387) which, in addition to enabling the device 386 to generate signals denoting the mass of tobacco particles in successive increments of the filler, also performs an additional important function, namely, compacting or compressing the filler immediately prior to entry into the draping zone.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of producing rod-shaped articles which constitute or form part of smokers' products, comprising the steps of establishing and maintaining a supply of tobacco particles; withdrawing from the supply a continuous layer of tobacco particles and converting the layer into a continuous stream; advancing the stream along a predetermined path; draping the stream into a web of wrapping material in a first portion of said path; monitoring the quantity of tobacco particles in successive increments of the stream in a second portion of said path upstream of said first portion and generating signals denoting the monitored quantities of tobacco particles; and automatically interrupting the converting step when a thus generated signal denotes that the quantity of tobacco particles in the corresponding increment of the stream exceeds a preselected value.

2. The method of claim 1, wherein said interrupting step includes utilizing the respective signal to initiate the interruption of said converting step.

3. The method of claim 1, wherein said monitoring step includes conveying through the stream a current of a gaseous fluid transversely of said path and ascertaining the difference between the characteristics of the current prior to penetration into and subsequent to issuance from the stream in said second portion of said path.

4. The method of claim 3, wherein said conveying step comprises establishing a subatmospheric pressure at one side of the stream in said second portion of said path to thereby induce the flow of atmospheric air across the stream whereby the pressure of air at said one side of the path fluctuates as a function of the quantity of tobacco particles advancing along said second portion of said path.

5. The method of claim 1, wherein said monitoring step includes ascertaining the height of successive increments of the stream, the height of the stream being proportional to the quantity of tobacco particles in the respective increments advancing along said second portion of said path.

6. The method of claim 5, wherein said ascertaining step includes optically scanning the height of the stream.

7. The method of claim 5, wherein said interrupting step includes terminating the converting step when a signal denoting the height of the respective increment of the stream indicates that such height exceeds a preselected value.

8. The method of claim 1, wherein said monitoring step includes capacitively measuring the quantity of tobacco particles in successive increments of the stream.

9. The method of claim 1, wherein said monitoring step includes establishing a constriction through which successive increments of the stream advance in said second portion of said path and ascertaining the forces which successive increments apply to such constriction, the magnitude of the forces being indicative of the quantity of tobacco particles in the respective increments of the stream.

10. The method of claim 1, wherein said monitoring step includes reducing the cross-sectional area of said second portion of said path so that successive increments of the stream are compressed during travel along said second portion of said path and the resistance which successive increments of the stream offer to compression is indicative of the quantity of tobacco particles therein.

11. The method of claim 10, wherein said interrupting step includes automatically terminating said converting step when said resistance rises to a preselected threshold value.

12. In a machine for the production of rod-shaped articles which constitute or form part of smokers' products, the combination of a source of tobacco particles; conveyor means defining an elongated path; means for withdrawing from said source a continuous layer of tobacco particles and for admitting the layer into said path so that the layer is converted into a continuous stream which advances lengthwise along said path; means for draping the stream into a web of wrapping material in a first portion of said path; means for monitoring the quantity of tobacco particles in successive increments of the stream in a second portion upstream of said first portion of said path, including means for generating signals denoting the quantity of tobacco particles in the respective increments of the stream; and means for automatically deactivating said withdrawing means to thereby interrupt the conversion of the layer into said stream when a signal denotes that the quantity of tobacco particles in the corresponding increment of the stream exceeds a preselected value.

13. The combination of claim 12, wherein said withdrawing means and said source together form part of the distributor of said machine and the width of the layer greatly exceeds the width of the stream.

14. The combination of claim 12, wherein said monitoring means comprises means for conveying a current of a gaseous fluid across the tobacco stream in said second portion of said path and means for ascertaining the difference between the characteristics of the current prior to penetration into and subsequent to issuance from the stream in said second portion of said path.

15. The combination of claim 14, wherein said current conveying means comprises a suction chamber disposed at one side of said path and arranged to draw atmospheric air across successive increments of the stream in said second portion of said path, said ascertaining means including transducer means arranged to generate signals denoting the pressure of air in said chamber.

16. The combination of claim 15, wherein said deactivating means comprises means for comparing the intensities of signals generated by said transducer means with a reference value and for interrupting the delivery of tobacco particles into said path when the intensity of a signal exceeds said reference value.

17. The combination of claim 12, wherein the height of the tobacco stream in said second portion of said path is indicative of the quantity of tobacco particles in the respective increments of the stream and said monitoring means comprises means for ascertaining the height of successive increments of the stream, said signal generating means comprising transducer means for generating signals denoting the ascertained height of successive increments of the stream in said second portion of said path.

18. The combination of claim 17, wherein said ascertaining means comprises means for optically measuring the height of the stream and said transducer means includes at least one optoelectronic transducer.

19. The combination of claim 12, wherein said monitoring means comprises means for capacitively measuring the quantity of tobacco particles in successive increments of the stream.

20. The combination of claim 12, wherein said monitoring means comprises means for compressing successive increments of the stream and said signal generating means includes a device arranged to generate signals denoting the resistance which successive increments of the stream offer to compression in said second portion of said path.

21. The combination of claim 20, wherein said compressing means comprises an elastically deformable stream-engaging member adjacent to said first portion of said path.

22. The combination of claim 21, wherein said deactivating means comprises means for interrupting the delivery of tobacco particles into said path when the intensity of a signal exceeds a predetermined threshold value.

23. The combination of claim 21, wherein said device comprises at least one deformation-monitoring element associated with said elastically deformable member.

24. The combination of claim 23, further comprising a common support for said elastically deformable member and said deformation-monitoring element.

* * * * *